US005238449A

United States Patent [19]

Stoney et al.

[11] Patent Number: 5,238,449

[45] Date of Patent: Aug. 24, 1993

[54] VENTILATORS

[75] Inventors: Arthur Stoney, Halstead; Arthur J. Burt, Ipswich; Richard Waters, Royston, all of Great Britain

[73] Assignee: Titon Hardward Limited, Essex, England

[21] Appl. No.: 781,344

[22] Filed: Oct. 25, 1991

[30] Foreign Application Priority Data

Oct. 25, 1990 [GB] United Kingdom ..... 9023310

[51] Int. Cl.[5] ..... E06B 7/02

[52] U.S. Cl. ..... 454/213

[58] Field of Search ..... 454/194, 213, 219, 222, 454/227, 254, 273, 274, 333, 334, 359

[56] References Cited

U.S. PATENT DOCUMENTS

| | | | |
|---|---|---|---|
| 500,880 | 8/1893 | Fransmann | 454/213 X |
| 944,250 | 12/1909 | Arnesen | 454/213 X |
| 1,119,288 | 12/1914 | Kurz | 454/213 |
| 2,890,717 | 6/1959 | Werder | 454/333 X |
| 4,794,852 | 1/1989 | Ee | 454/271 |
| 4,899,647 | 2/1990 | Garries et al. | 454/354 X |

FOREIGN PATENT DOCUMENTS

| | | |
|---|---|---|
| 2118030 | 11/1971 | Fed. Rep. of Germany . |
| 2086925 | 12/1971 | France . |
| 2272346 | 12/1975 | France . |

*Primary Examiner*—Harold Joyce

*Attorney, Agent, or Firm*—Millen, White, Zelano & Branigan

[57] ABSTRACT

A canopy for use with a ventilator slot extending through a window frame has pressure differential responsive flow control means arranged to progressively close the flow passage through the canopy as the pressure differential increases, thus preventing draughts. The canopy has a body with an inlet and an outlet and a bowed wall therebetween. A normally straight baffle strip is attached to the center of the wall and there are non-aligned apertures in the wall and the baffle respectively. When the pressure differential between the inlet and outlet is low, the baffle is well-spaced from the wall but as the pressure differential increases the baffle is bowed progressively towards the wall against the inherent bias of the strip to progressively close the flow path through the apertures.

5 Claims, 3 Drawing Sheets

VENTILATORS

BACKGROUND OF THE INVENTION

This invention relates to ventilators, more particularly but not exclusively for use in rooms with sealed windows and/or double glazing where it is desirable to provide for ventilation without having to open the window. This type of ventilation is now often referred to as "secondary ventilation" and has in recent years been achieved by the insertion into a slot cut or formed in the surrounds of windows and the like of a slot ventilator. The inner end of the slot may be left open but is usually provided with a manually operable closure or a grill while on the outer side there is often a canopy extending outwardly and downwardly from the top of the slot and providing a downwardly facing opening which may incorporate an insect screen, the canopy thus shielding the slot from the ingress of rain and also dust and dirt.

It has been found that if the closure, when provided, is left open during windy conditions a draught blows through the ventilator. The present invention relates to improvements in such ventilation means and in particular has as an object the avoidance of such draughts.

SUMMARY OF THE INVENTION

The invention provides a canopy for use with a ventilator slot the canopy incorporating pressure differential control means arranged to progressively close the flow passage through the canopy as the pressure differential increases. The canopy may incorporate a first wall having apertures therethrough and a baffle for obturating the apertures and biasing means tending to move the baffle away from the apertures against an increasing pressure differential across the wall. The wall containing the apertures may be a rear wall of the canopy intended to directly overlie the outer end of the slot. The wall may contain a row of apertures extending along the length of the canopy, the apertures for example being in the shape of rectangles. The baffle may be in the form of a strip extending generally parallel with the wall and may include apertures which are at least partially out of register with the apertures in the wall when the strip is adjacent the wall. The bias may be provided by one or more springs but preferably the strip is resilient and is shaped and located in the canopy so that in the absence of a pressure differential the strip is at least partially spaced away from the wall and moves towards the wall as the pressure differential increases. The strip may be secured to the wall and in contact therewith at a point along its length and diverge from the wall away from the point of anchorage. There may be abutment means on the strip or the wall or both to prevent the strip making face to face contact with the wall in order to ensure that a limited degree of ventilation will always be possible and to prevent wringing to ensure that the strip will separate from the wall when the pressure differential decreases.

The invention may be carried into practice in various ways and one example of a canopy for a ventilator embodying the invention will now be described by way of example with reference to the accompanying drawings.

DESCRIPTION OF THE PREFERRED EMBODIMENT

Figure 1:
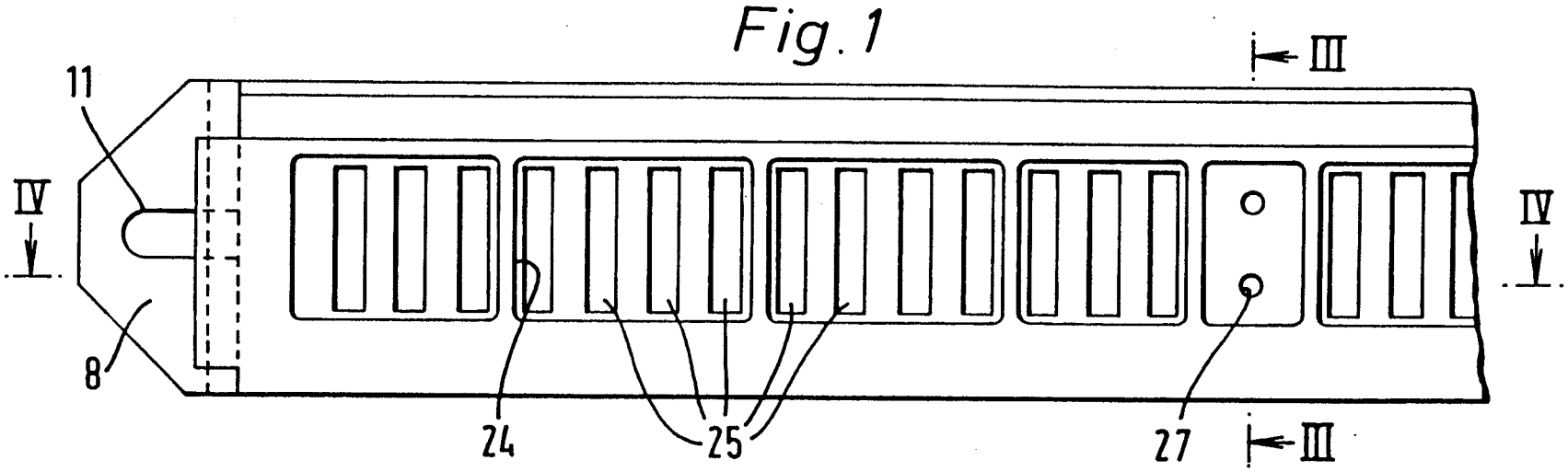
FIG. 1 is a partial rear elevation of the canopy.
Figure 3:
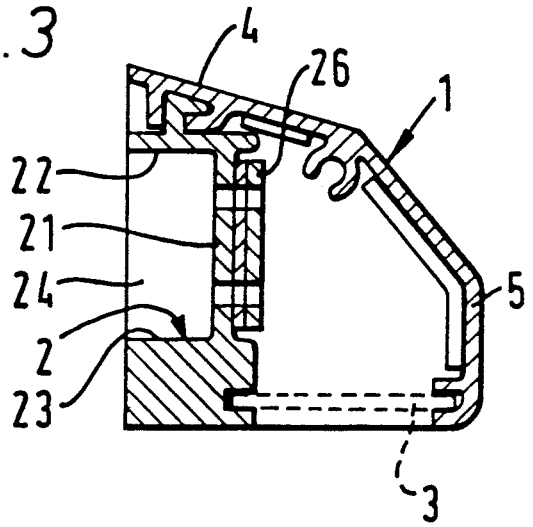
FIG. 3 is a cross section of the canopy on the line III—III in FIG. 1.
Figure 5:
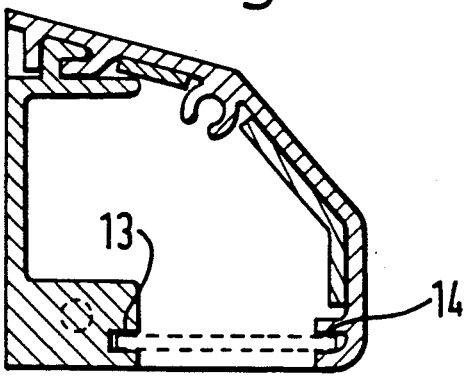
FIG. 5 is a cross section similar to FIG. 3 on the line V—V in FIG. 4

As can best be seen from FIGS. 1 and 3, a canopy comprises essentially an elongate box which is in the form of a tube made from three components 1, 2 and 3, the first constituting the body of the canopy and providing the upper and front walls 4 and 5 of the canopy, the second providing the rear wall of the canopy and the third constituting an insect screen 7 which forms the bottom wall of the canopy. The ends of the tube are closed by moulded end pieces 8 and 9 having openings 11 for screws by which the canopy can be secured to the surface to which it is attached.

Figure 4:
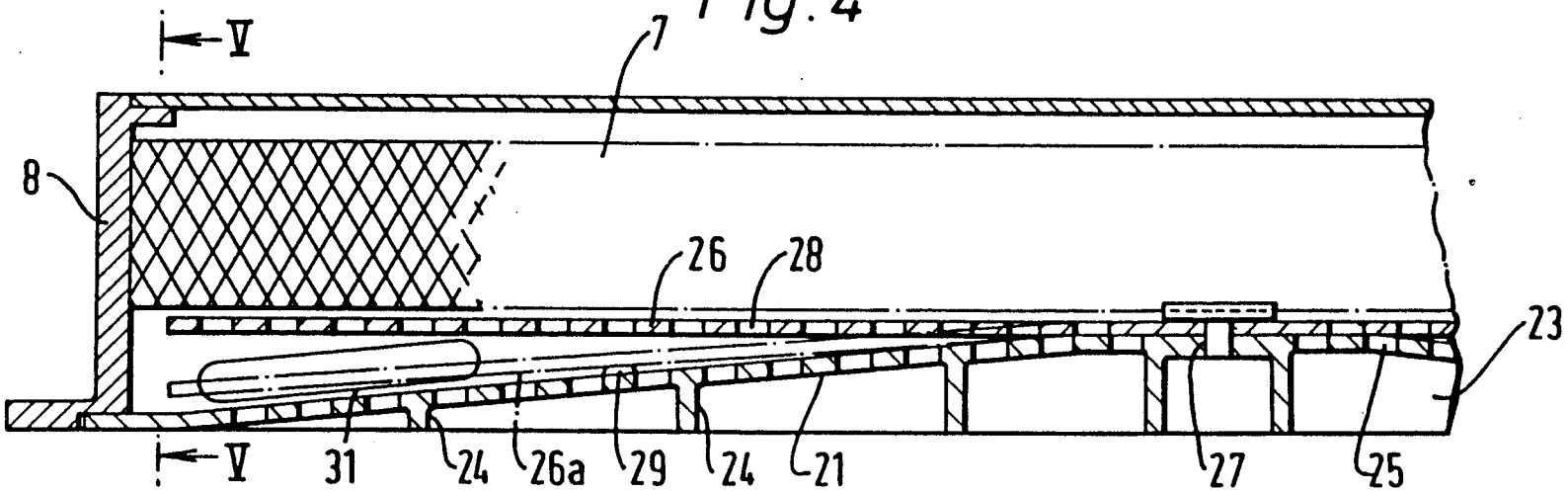
FIG. 4 is a partial horizontal longitudinal section on the line IV—IV in FIG. 1.
Figure 2:
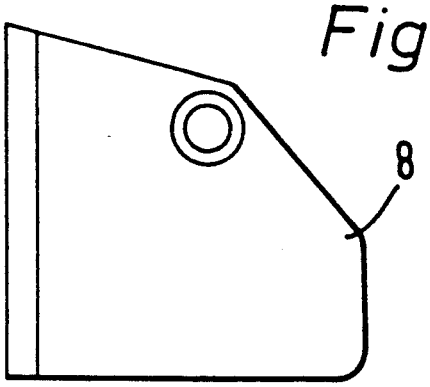
FIG. 2 is an end elevation of the canopy.

The canopy has a generally downwardly facing open mouth which is closed by the insect screen 7 the longitudinal edges of the screen being retained in slots 13,14 moulded in the lower edges of the walls 2 and 1 respectively. The rear wall of the canopy is afforded by the second component 2 which is a complex moulding having a longitudinal wall 21 which is generally bow shaped in plan as can be seen in FIG. 4 and is supported by upper and lower horizontal walls 22,23 interconnected by vertical walls 24 to provide a coffered effect when viewed from the rear. The bowed longitudinal wall is formed with twenty eight rectangular apertures 25. A baffle 26 in the form of a slightly flexible strip is secured by rivets 27 to the central portion of the longitudinal wall and is formed with twenty eight rectangular apertures 28 which, as can be seen from FIG. 4, are generally out of register with the apertures 26 in the wall 21. In the unstressed condition of the strip 26 as shown in FIG. 4, the strip is straight or flat but under the effects of differential pressure, as will be described, it is able to deflect to the position 26a shown in FIG. 4 by chain dotted lines where it is adjacent to the rear wall 21 but remains spaced by a short distance from the rear wall by a stop 29.

The lower wall 23 contains a low pressure slot 31 which ensures a minimum amount of ventilation at all times.

Figure 6:
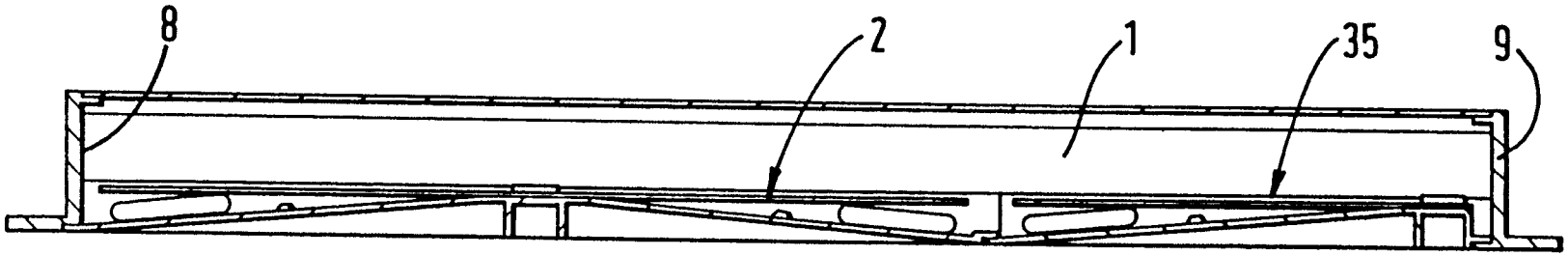
FIG. 6 is a diagrammatic horizontal longitudinal section similar to FIG. 4 but to a smaller scale and showing the whole of the ventilator canopy.

It will be appreciated that FIGS. 1 and 4 show only one end portion of a complete canopy which may be manufactured in any convenient length. FIG. 6 shows one such canopy in which a rear wall structure 2 as described is combined with a similar structure 35 which is of only half the length, the two being placed end to end within a main body which is of appropriate length. Clearly, canopies of other lengths can be devised, one such being of twice the length of one rear wall structure 2 instead of only one and a half times as shown in FIG. 6.

Operation of the canopy is as follows.

When there is a small differential pressure between the downwardly facing mouth of the canopy and the slot against which the canopy is positioned, the baffle 26 will be in the condition shown in full lines in FIG. 4. Air can flow into the canopy through the insect screen 7, through the apertures 28 in the baffle 26 and then through the apertures 25 in the wall 21 and into the slot. As the pressure differential increases, the end portions or wings of the baffle 26 will tend to move against the resilience of the baffle towards the wall 21 thus increasing the resistance to air flow. When the pressure differential reaches a certain level the baffle 21 will engage the stop 29 at which stage the more central apertures 25 in the wall 21 will be substantially closed while a progressively greater but still small flow will be possible through the outer apertures. Up to this stage the flow rate through the canopy and into the slot will be at least approximately independent of the differential pressure. However, because of the stop 29, the baffle 26 cannot engage flat against the wall 21 so that there will always remain a small flow path for air through the wall 21 to provide a degree of ventilation together with the small flow possible through the slot 31. When the pressure differential again falls, the resilience of the baffle 26 will tend to move the wings of the baffle away from the wall 21 thus progressively increasing the cross section of the flow path through the canopy and into the slot until the baffle 26 returns to its unstressed position.

We claim:

1. A canopy for use with a ventilator slot, the canopy comprising:

an elongated housing having an interior, a bottom wall having an aperture to provide an inlet to the interior of the housing, imperforate front and top walls, a rear aperture to provide an outlet from said interior so as to provide a flow path for air through said interior from said inlet to said outlet, a longitudinal wall extending across said flow path, the longitudinal wall having an upstream side and a downstream side and containing a first set of aperture spaced longitudinally along said longitudinal wall, and a resilient baffle strip secured at only one point of anchorage along its length substantially proximate the midpoint of the baffle strip to the upstream side of said longitudinal wall, said baffle strip extending away from said point of anchorage as a pair of cantilevers and said baffle strip having a second set of apertures spaced longitudinally along said baffle strip, the second set of apertures being at least partially out of alignment with the first set of apertures; said longitudinal wall and said baffle strip being configured wherein, in the absence of a differential air pressure between said inlet and said outlet, said baffle strip is biased by its resiliency to a first position where the baffle strip diverges away from said longitudinal wall progressively more from said point of anchorage and, while in the presence of an increasing positive differential air pressure between said inlet and said outlet, said baffle strip moves progressively toward said longitudinal wall to a second position which partially obturates said first set of apertures.

2. A canopy according to claim 1, wherein the apertures of said first set and the apertures of said second set are rectangles.

3. A canopy according to claim 1, which further comprises abutment means disposed between said strip and said longitudinal wall to prevent said strip from making face to face contact with said longitudinal wall so as to avoid completely blocking air flow therethrough.

4. A canopy according to claim 1, wherein the longitudinal wall extends obliquely with respect to the front wall.

5. A canopy of claim 1, wherein the ventilator slot is in combination with a window frame.

* * * * *